US008418522B1

(12) United States Patent
Liao

(10) Patent No.: US 8,418,522 B1
(45) Date of Patent: Apr. 16, 2013

(54) HAND/PNEUMATICS DUAL OPERATION VACUUM PULLING DEVICE

(75) Inventor: Po Lin Liao, Taichung (TW)

(73) Assignee: Lih Yann Industrial Co., Ltd., Taichung (TW)

( * ) Notice: Subject to any disclaimer, the term of this patent is extended or adjusted under 35 U.S.C. 154(b) by 0 days.

(21) Appl. No.: 13/337,887

(22) Filed: Dec. 27, 2011

(51) Int. Cl.
*B21J 13/08* (2006.01)

(52) U.S. Cl.
USPC ..... 72/457; 72/453.01; 72/478; 72/705

(58) Field of Classification Search ..... 72/457, 72/459, 465.1, 705
See application file for complete search history.

(56) References Cited

U.S. PATENT DOCUMENTS 3,728,891 A * 4/1973 Hall, Jr. ..... 72/465.1
4,753,104 A * 6/1988 Strozier ..... 72/457
5,727,418 A * 3/1998 Strozier ..... 72/457
5,934,139 A * 8/1999 Tucker ..... 72/479
7,430,891 B1 * 10/2008 Wang ..... 72/705

* cited by examiner

*Primary Examiner* — David B Jones
(74) *Attorney, Agent, or Firm* — Muncy, Geissler, Olds & Lowe, PLLC

(57) ABSTRACT

A hand/pneumatics dual operation vacuum pulling device includes an elongate shank and a slidable backward ram fit to the shank. The shank has an end to which a suction cup is attached. The shank has an upper end to which a handgrip having a pressure relief seat is mounted. A ramp stop section is formed below the pressure relief seat. The handgrip can selectively and switchably couple with a hand-operating pump piston to form a hand-operating vacuum pulling device, or couple with a pneumatic operation seat to form a pneumatically-operating vacuum pulling device. For hand operation or pneumatics operation, the vacuum pulling device is allowed to easily switch between the two modes according to the availability of power supply and the site of use, thereby achieving an excellent device for one device having two ways of use.

7 Claims, 13 Drawing Sheets

HAND/PNEUMATICS DUAL OPERATION VACUUM PULLING DEVICE

BACKGROUND OF THE INVENTION

1. Field of the Invention

The present invention relates to the field of vacuum pulling device, and in particular to a hand/pneumatics dual operation vacuum pulling device, which can selectively operates as a pneumatic vacuum puller when pressurized air supply is available and can serve as a hand-operating vacuum puller when no pressurized air is available and still provide a strong suction and pulling force even operated by hands.

2. The Related Arts

A conventional dent puller for automobile metal sheet is commonly used to repair deformed metal sheet of a car. The conventional automobile metal sheet puller is generally classified as traditional hand-operating dent puller and later developed pneumatic dental puller. The traditional hand-operating automobile dent puller is rarely seen in the market due to a number of design defects. The pneumatic automobile dent puller is not easy to carry and use for it needs air compressor to generate a suction force and thus requires a constant supply of electrical power. The present inventor has proposed previously a "hand-operating vacuum pulling device" which is relatively advanced. Yet, a pneumatic puller is still of advantages in operation, even through it operation is limited by the supply of electrical power.

In view of the drawbacks of the "hand-operating vacuum pulling device" that was previously proposed by the present inventor and the known pneumatic dent pullers, it is desired to have a creative breakthrough in the technical field of dent puller or similar pulling devices in order to overcome those drawbacks.

Thus, the present invention aims to provide a novel pulling device with the purpose of eliminating the drawbacks of the known devices and providing a practical device.

SUMMARY OF THE INVENTION

An objective of the present invention is to provide a hand/pneumatics dual operation vacuum pulling device, which has all the advantages of a hand-operating vacuum pulling device and a pneumatically-operating vacuum pulling device, is easy to carry and stow, has a low purchasing expenditure, and allows easy switching between the two modes according to the availability of power supply and the site of use, thereby achieving an excellent device for one device having two ways of use.

To achieve the above objective, the present invention provides a hand/pneumatics dual operation vacuum pulling device, which comprises an elongate shank, a slidable backward ram, a suction cup, a handgrip comprising a pressure relief seat, a hand-operating pump piston, and a pneumatic pumping head, wherein the elongate shank receives the slidable backward ram to fit thereon. The elongate shank has an end to which the suction cup is attached. A ram stop section is arranged below the pressure relief seat. The hand-operating pump piston has a free end to which a ring-shaped cove is attached. The elongate shank has an upper end to which the handgrip having the pressure relief seat is mounted. The handgrip can selectively couple with a hand-operating pump piston to form a hand-operating vacuum pulling device, or the hand-operating pump piston can be removed to allow the handgrip to alternatively couple a pneumatic operation seat to form a pneumatically-operating vacuum pulling device. The pneumatic head forms first, second, and third passages that are joined to form a T-shaped configuration. The first passage is connected to a quick coupler and a switch. The second passage is connected to a one-way valve. The third passage is connected to a pneumatic sleeve to communicate the suction cup. The suction cup can be replaced by a hook, which has a front end forming a spherical body to prevent undesired hooking that causes damage to tube or hurt users. The hook may convert the pneumatically-operating vacuum pulling device or the hand-operating vacuum pulling device into a destruction tool, a dismantling tool, a hooking tool, or a pulling tool for deformed metal sheet.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
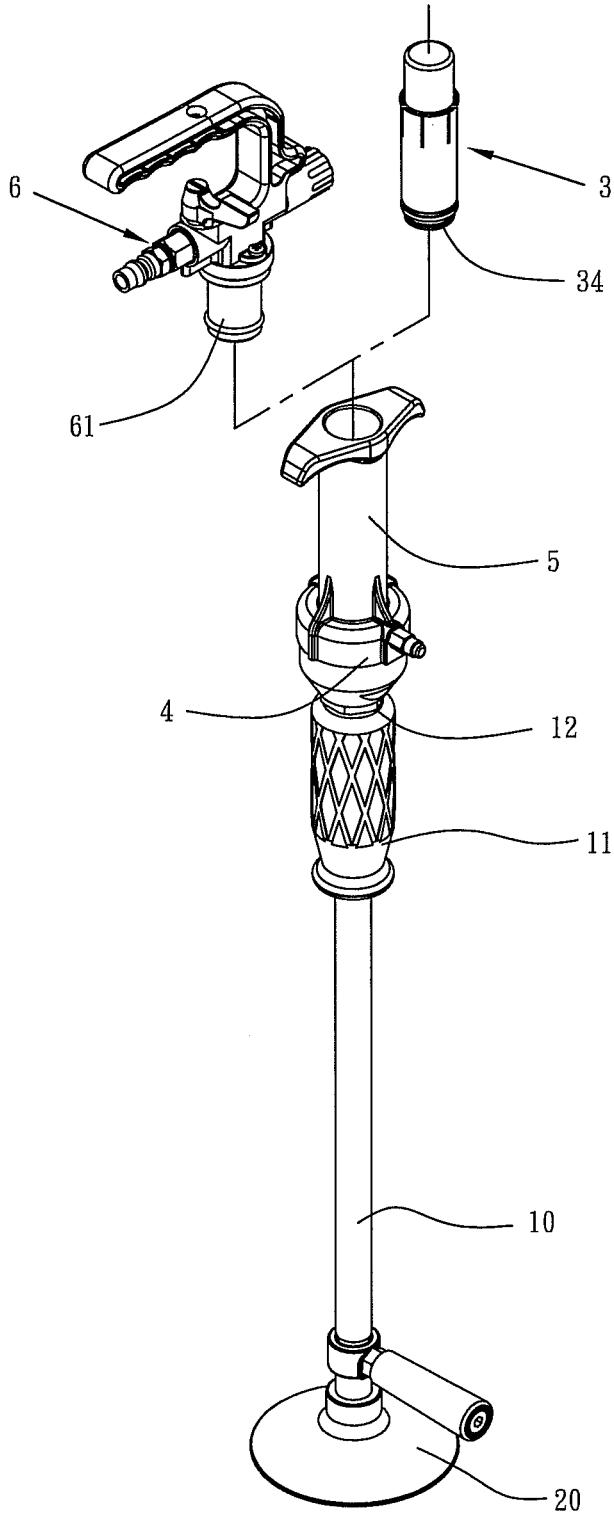
FIG. 1 is a perspective view showing a dual operation vacuum pulling device according to a preferred embodiment of the present invention, which is selectively switched to a hand-operating vacuum pulling device by combining with a hand-operating pump piston or a pneumatically-operating vacuum pulling device by combining with a pneumatic operation seat.

With reference to the drawings and in particular to FIG. 1, which is a perspective view showing a vacuum pulling device according to a preferred embodiment of the present invention, the vacuum pulling device of the present invention is of dual uses, namely, the pulling device may be combined with a hand-operating pump piston to form a hand-operating vacuum pulling device or may alternatively be combined with a pneumatic operation seat to form a pneumatically-operating vacuum pulling device.

Thus, the present invention provides a hand/pneumatics dual operations vacuum pulling device. The dual operation vacuum pulling device comprises the following components, which will be described in more detail.

An elongate shank 10, which is hollow, receives therein a tube 13. The elongate shank 10 has a free end that forms a first internal threading 101 for mating a second external threading 171 formed on a coupling member 17. The coupling member 17 also has a second internal threading 172 for mating a first external threading 22 of a suction cup 20. The elongate shank 10 receives a backward ram 11 to fit thereto in a vertically slidable manner. The, the elongate shank 10 receives a ring 16 and a transverse handle 14 fit to a proximal end thereof. The transverse handle 14 has a third external threading 141 that engages and extends through a nut 16 and a third internal threading 161 that extends through the ring 16 to abut the elongate shank 10.

The suction cup 20 is coupled to the end of the elongate shank 10. Preferably, the suction cup 20 is made in various sizes so that suction cups that are of different sizes are available for user's selection. The suction cup 20 has a top end forming a through hole 21 and a first external threading 22.

Figure 2:
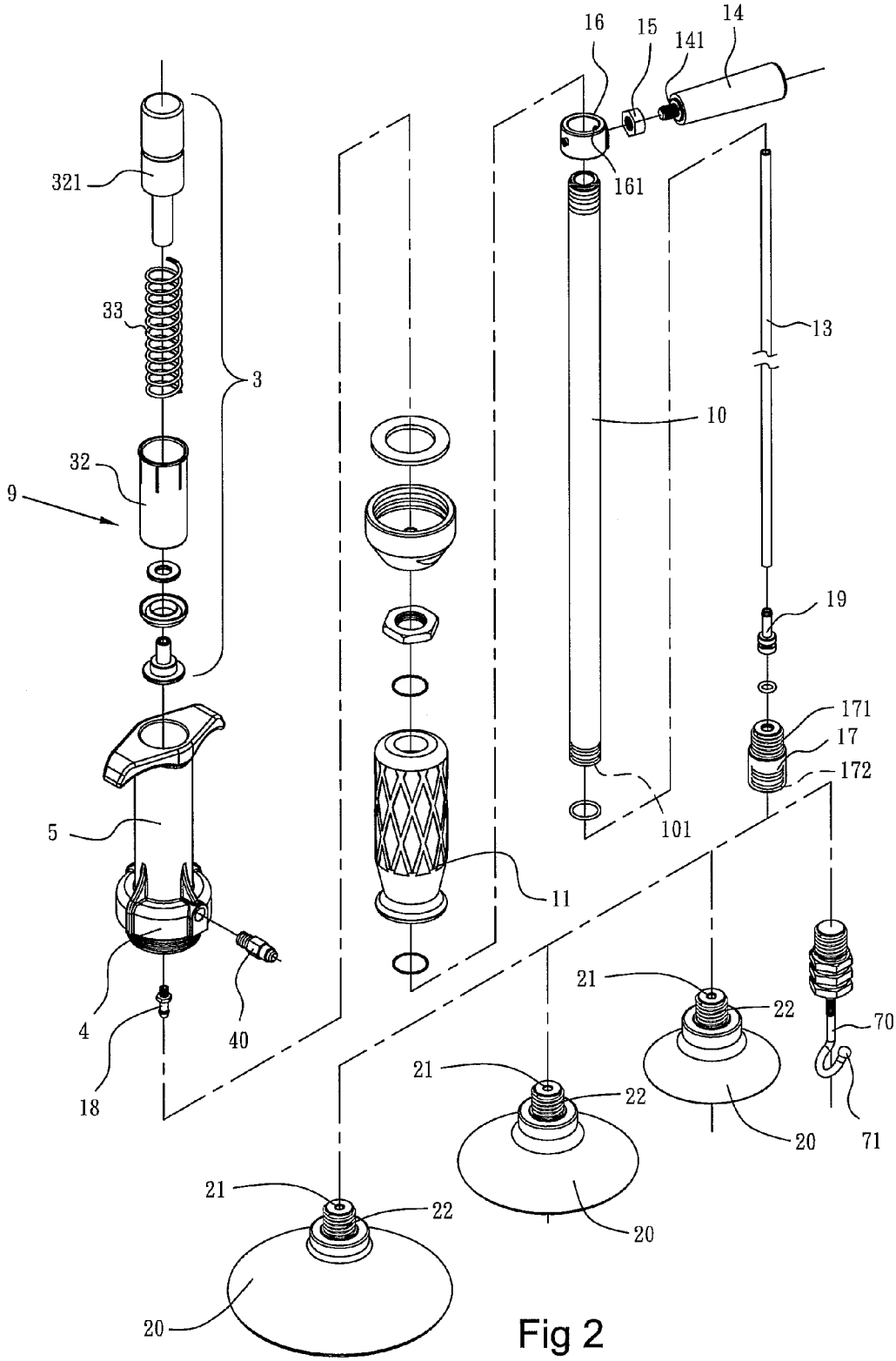
FIG. 2 is an exploded view of the dual operation vacuum pulling device of the present invention that is used with the hand-operating pump piston to form a hand-operating vacuum pulling device.

A handgrip 5 is mounted to an upper end of the elongate shank 10 and the handgrip 5 comprises a pressure relief seat 4. The tube 13, as shown in FIG. 2, is received in the elongate shank 10 and communicates the handgrip 5 and the suction cup 20. A ram stop section 12 is arranged below the pressure relief seat 4.

Figure 3:
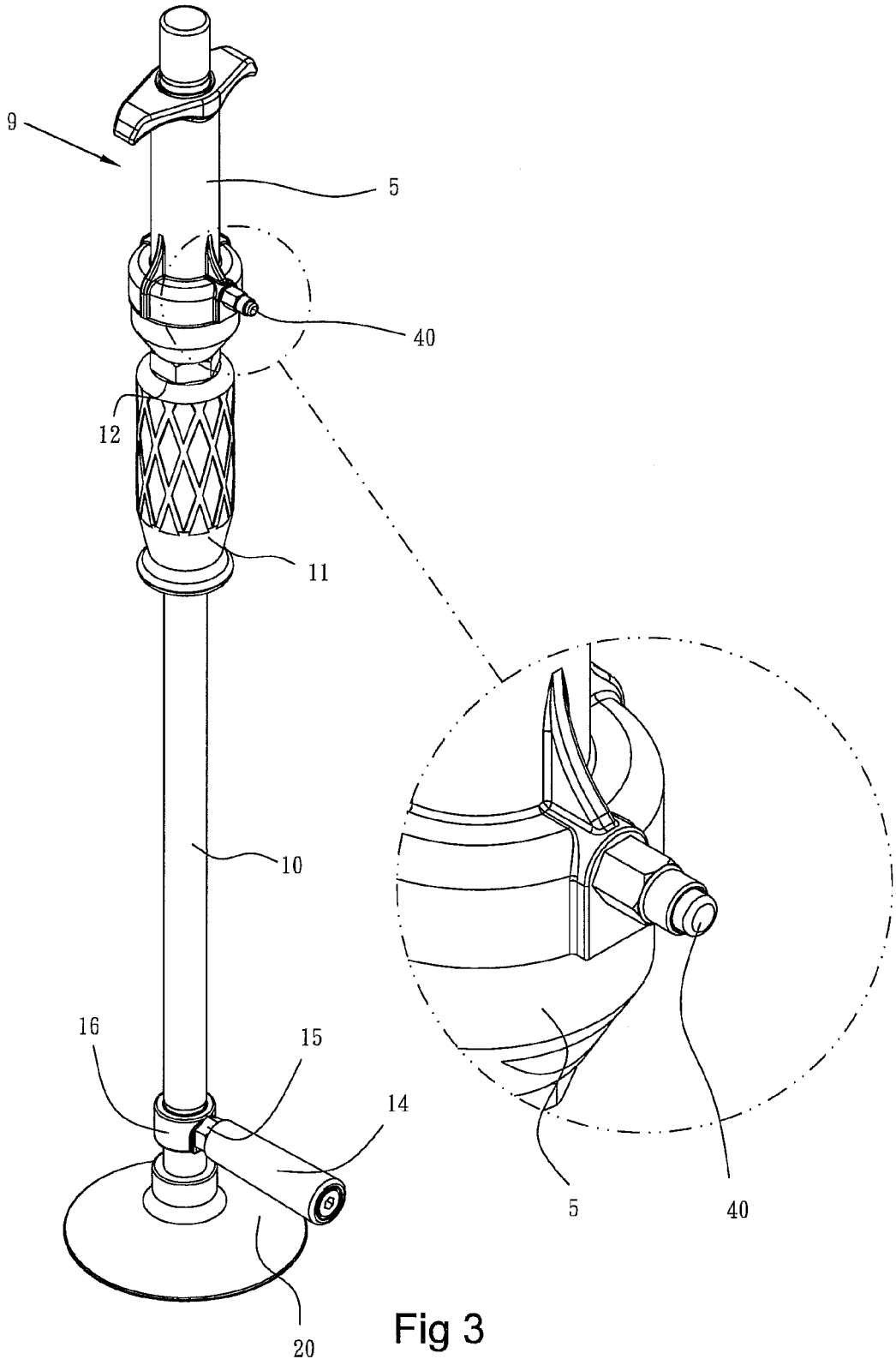
FIG. 3 is a perspective view of the dual operation vacuum pulling device of the present invention that is used with the hand-operating pump piston to form the hand-operating vacuum pulling device.

A hand-operating pump piston 3 has an end 34 that is coupled in the handgrip 5 in order to form a hand-operating vacuum pulling device 9, as shown in FIG. 3.

Figure 8:
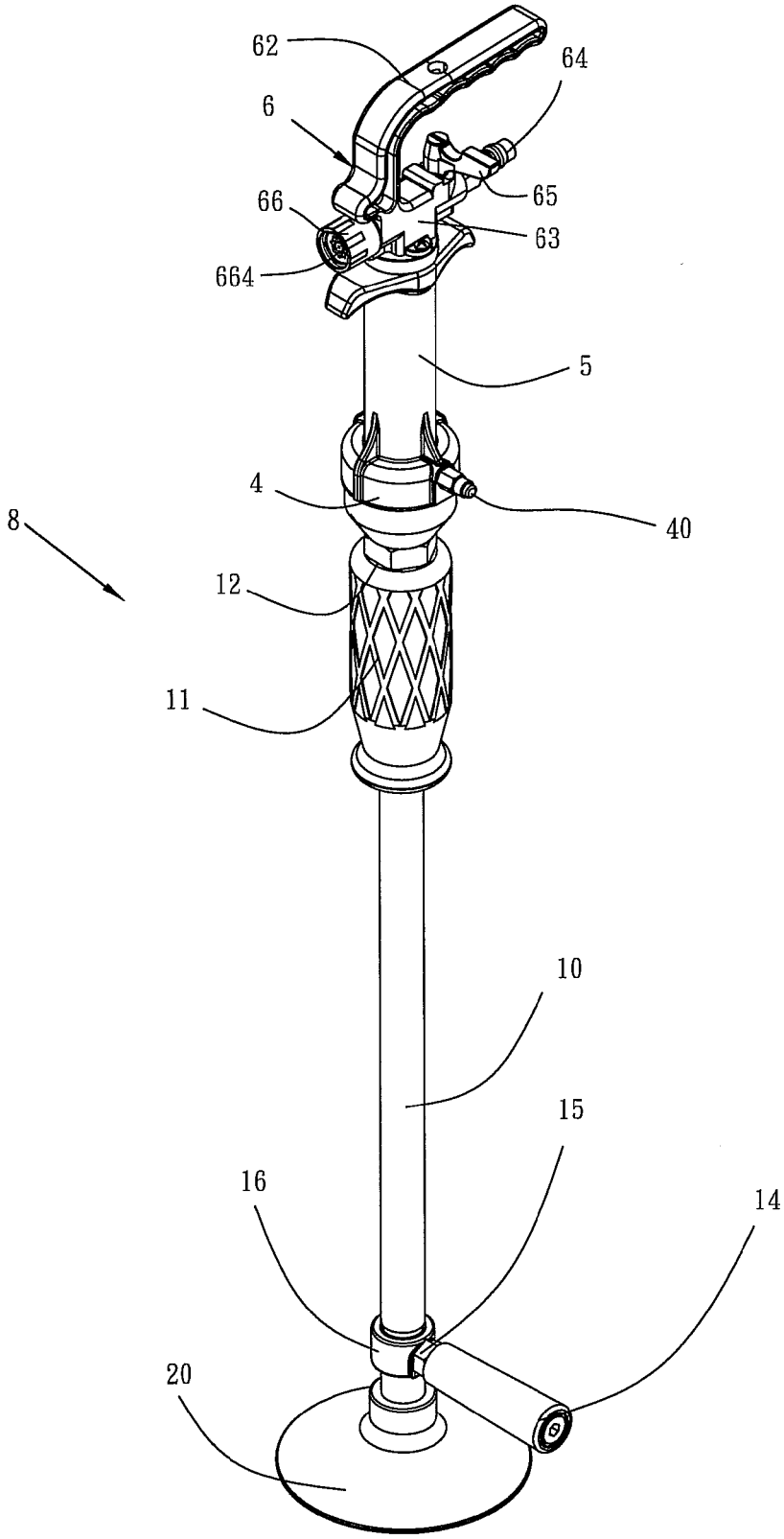
FIG. 8 is a perspective view of the dual operation vacuum pulling device of the present invention that is used with the pneumatic operation seat to form the pneumatically-operating vacuum pulling device.
Figure 9:
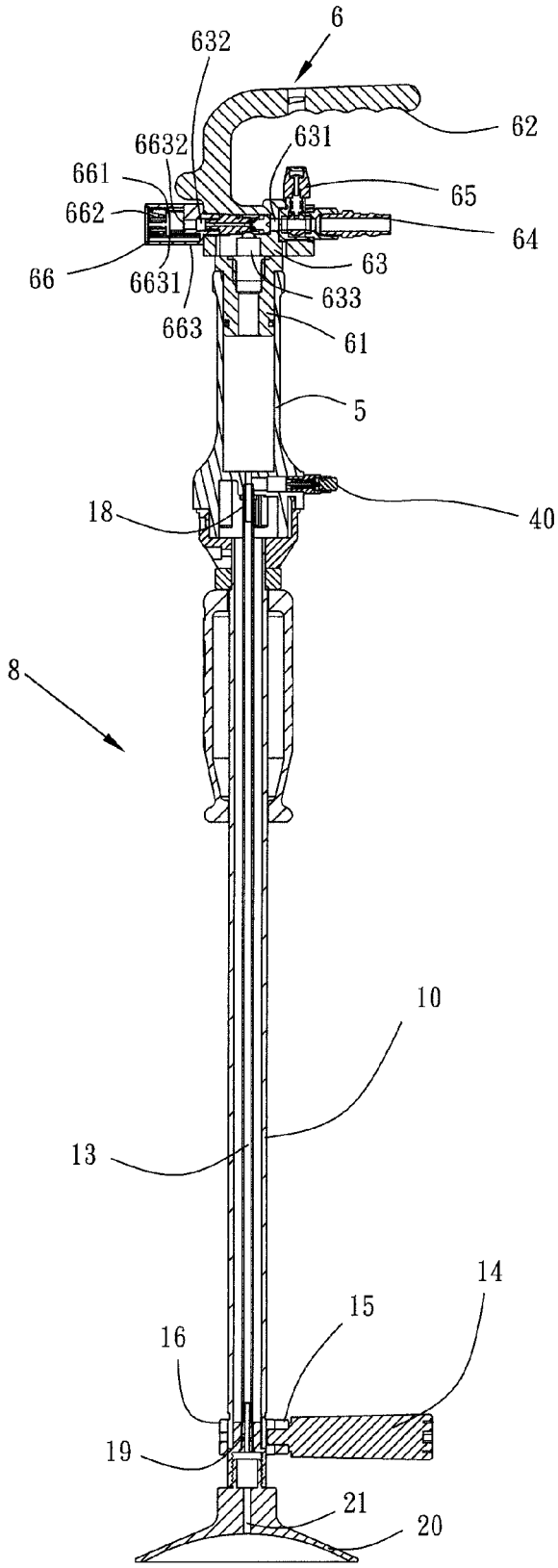
FIG. 9 is a cross-sectional view of the dual operation vacuum pulling device of the present invention that is used with the pneumatic operation seat to form the pneumatically-operating vacuum pulling device.
Figure 10:
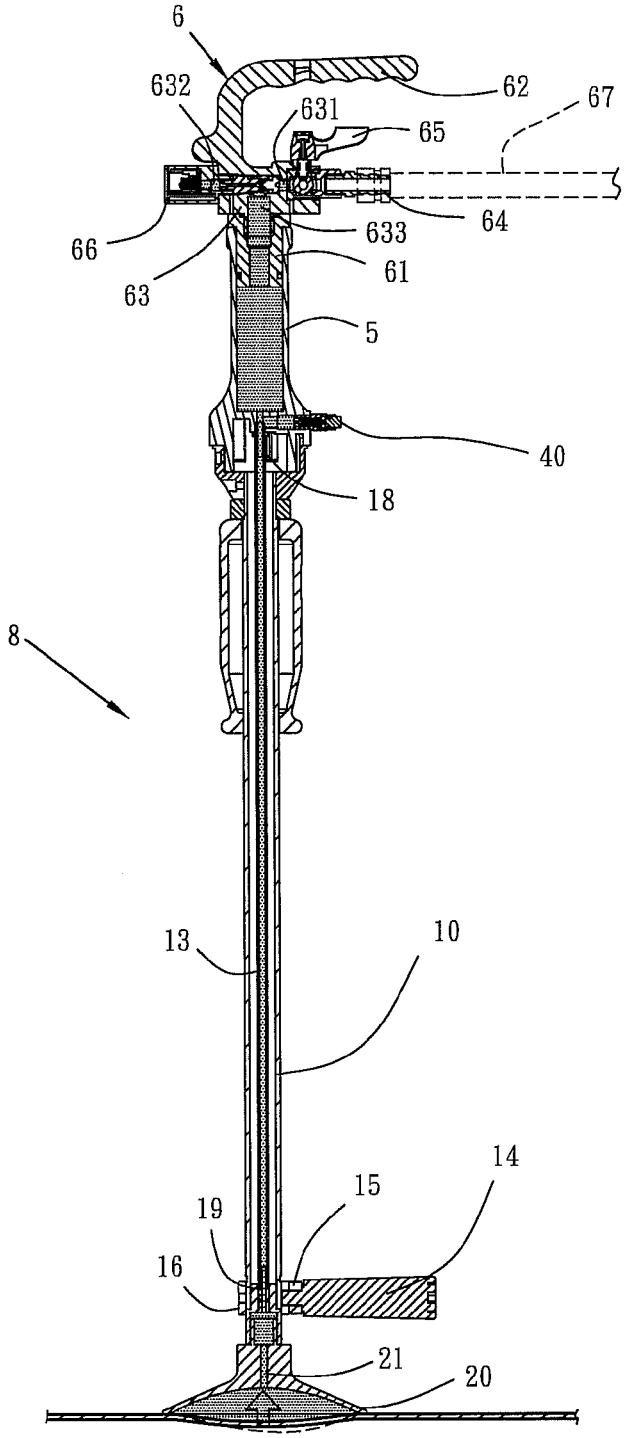
FIG. 10 is a cross-sectional view showing a vacuum forming operation of the dual operation vacuum pulling device of the present invention that is used with the pneumatic operation seat to form the pneumatically-operating vacuum pulling device.

A pneumatic operation seat 6 is coupled in the handgrip 5 with a pneumatic sleeve 61 to form a pneumatically-operating vacuum pulling device 8, as shown in FIG. 8.

Referring to FIGS. 2-6, the hand-operating pump piston 3 comprises a depression stem 321 that is combined with a spring 33 and a piston assembly 32. After the piston assembly 32 has been driven to induce a vacuum condition, the backward ram 11 is instantaneously moved upward to induce a backward impacting force that helps realizing vacuum pulling effect through hand operation.

Figure 4:
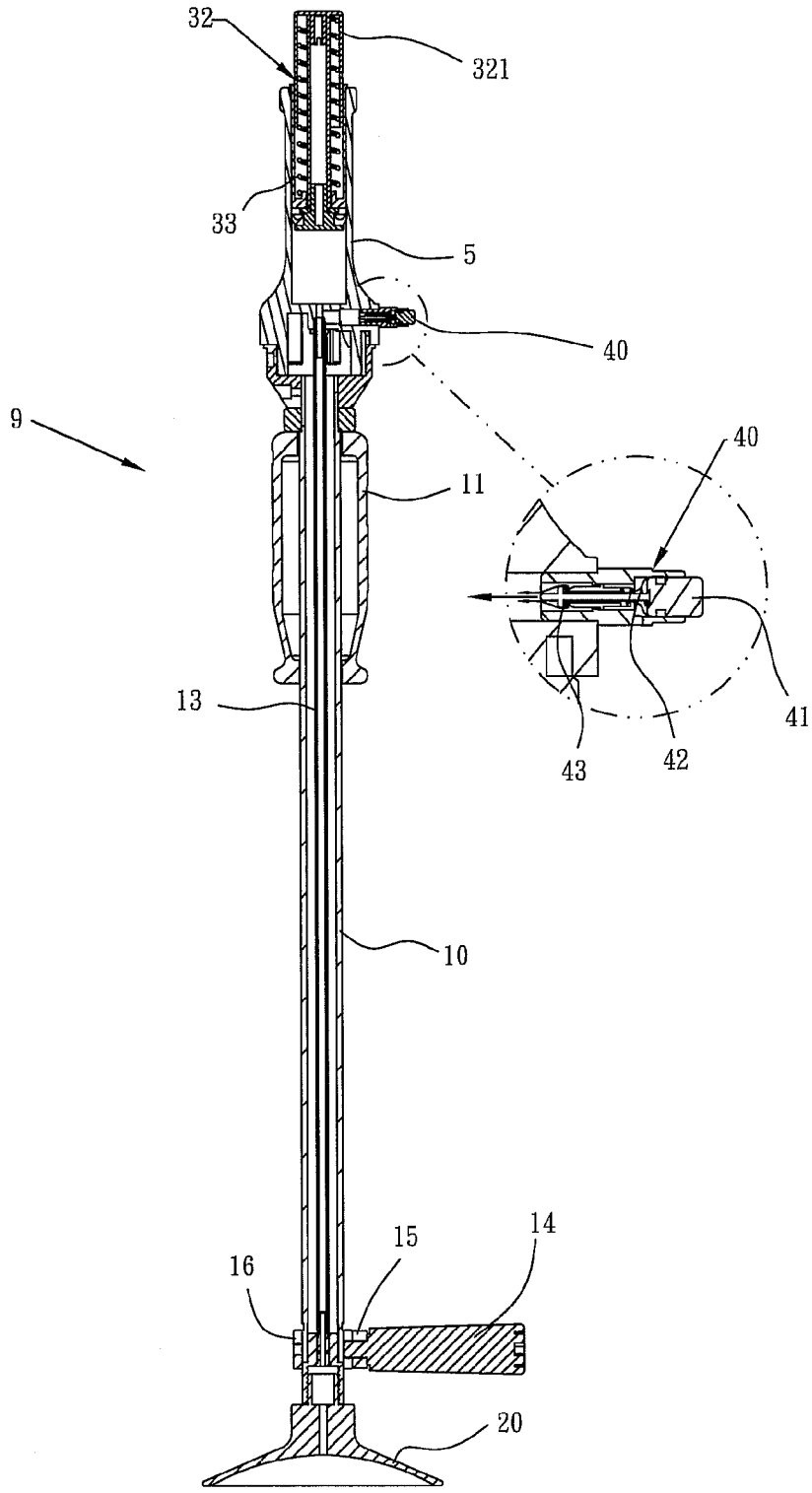
FIG. 4 is a cross-sectional view of the dual operation vacuum pulling device of the present invention that is used with the hand-operating pump piston to form the hand-operating vacuum pulling device.
Figure 5:
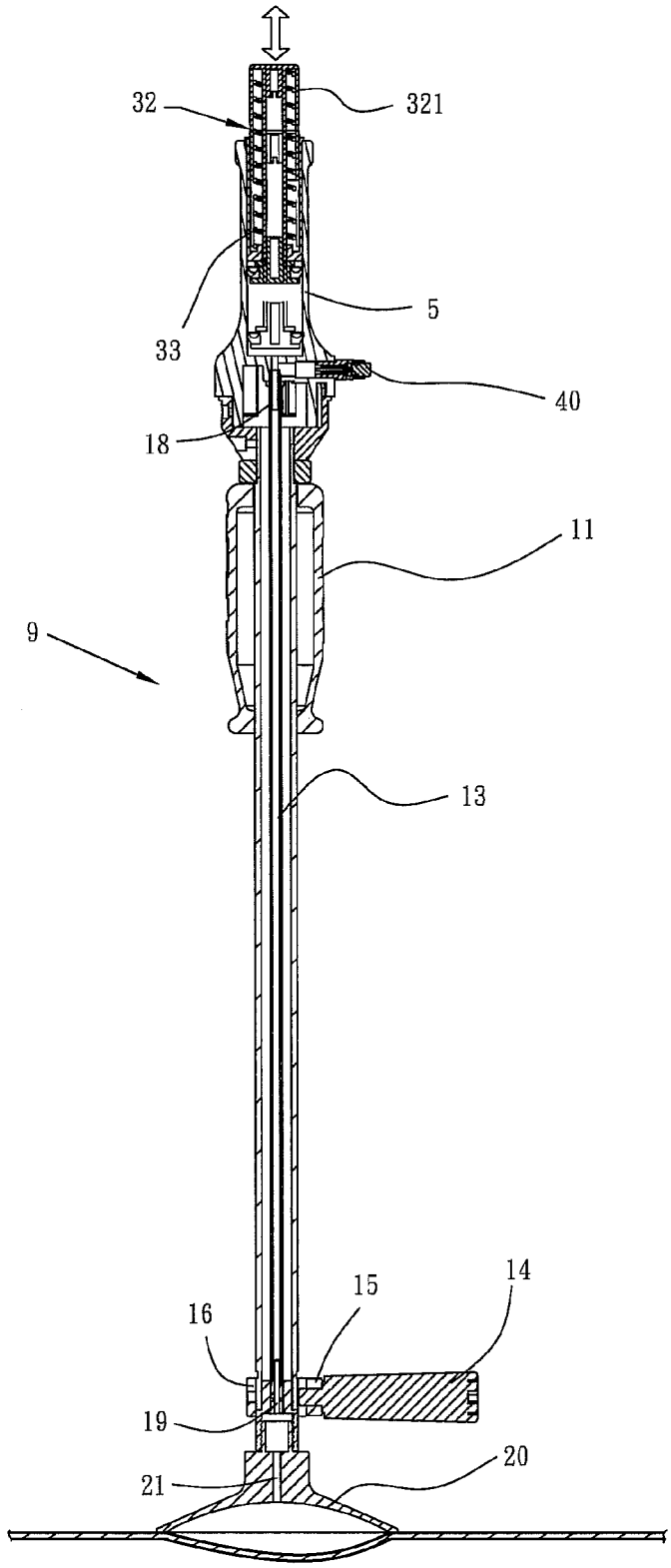
FIG. 5 is a cross-sectional view showing an operation of the dual operation vacuum pulling device of the present invention that is used with the hand-operating pump piston to form the hand-operating vacuum pulling device.

The pressure relief seat 4 has an end to which a pressure relief valve 40 is mounted. The pressure relief valve 40 comprises a relief button 41, which when pressed down, as shown in FIG. 4, compresses an elastic element 42 to move away a plug 43 so as to release the vacuum by allowing air to flow from the relief button 41 through the tube 12 into the suction cup 20 to release the suction force of the suction cup 20.

As shown in FIGS. 2-6, an interior space of the piston assembly 32 that is used in drawing in air for inducing vacuum is in communication, through the tube 13, with a suction space of the suction cup 20, whereby when a depression stem 321 of the piston assembly 32 of the hand-operating pump piston 3 is pressed down, air contained in the suction cup 20 is forced to flow outward through the piston assembly to gradually induce vacuum inside the suction cup and the piston assembly 32 is caused to gradually descend toward the suction cup 20 until it no longer possible to pull up the depression stem 321.

Figure 6:
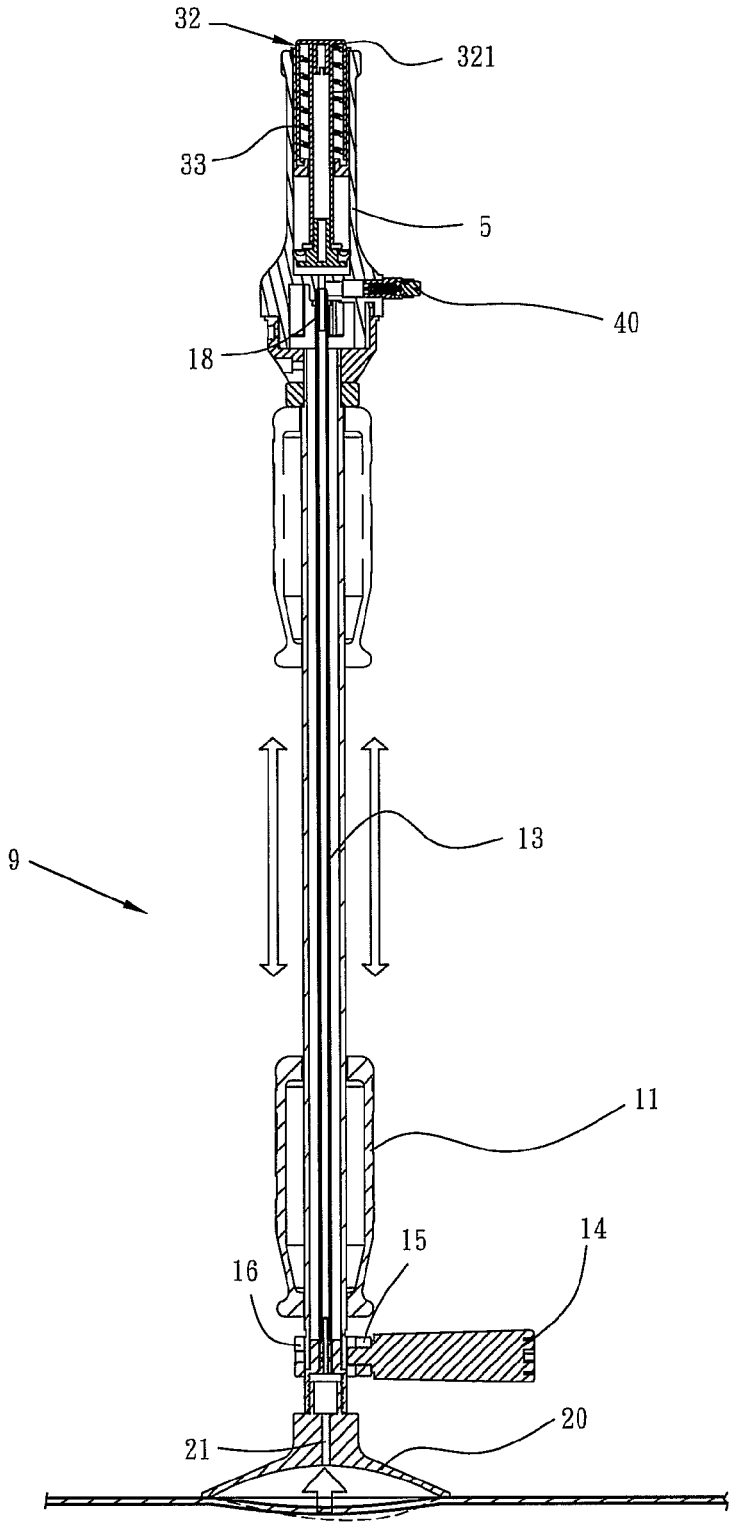
FIG. 6 is a cross-sectional view showing an operation of a backward ram of the dual operation vacuum pulling device of the present invention that is used with the hand-operating pump piston to form the hand-operating vacuum pulling device.
Figure 7:
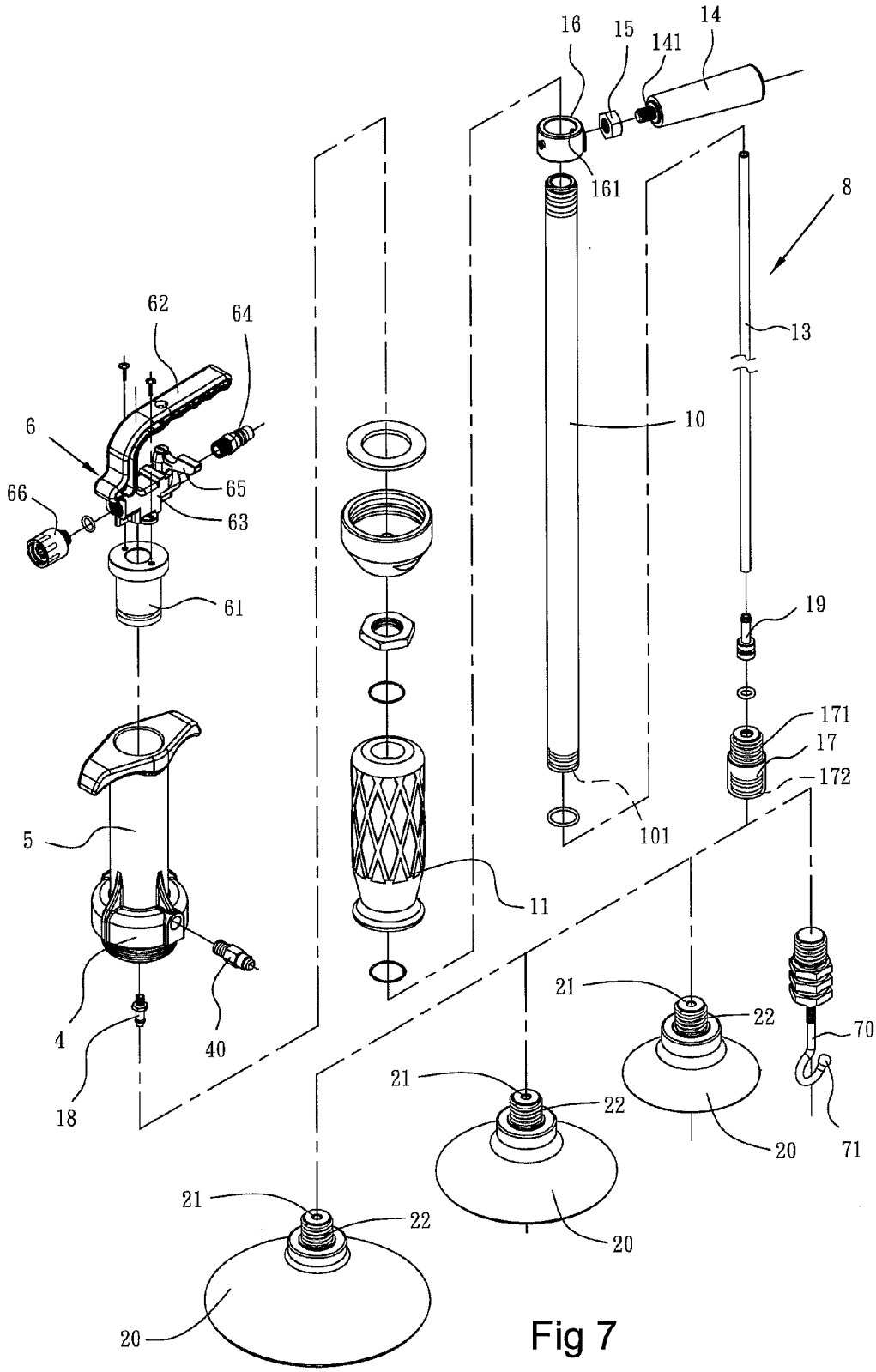
FIG. 7 is an exploded view of the dual operation vacuum pulling device of the present invention that is used with a pneumatic operation seat to form a pneumatically-operating vacuum pulling device.

With the suction cup 20 reaching a predetermined level of suction force, the backward ram 11 is instantaneously and forcibly moved toward and thus impacting the ram stop section 12 located below the pressure relief seat 4 and a backward impact force is induced as shown in FIG. 6, which effectively pulls the elongate shank 10 and the suction cup 20 backward to thereby pull, through the suction cup 20, a dent that is formed on a metal sheet up and level the dent. In this way, repairing of dent of metal sheet can be done without removing internal part of a car. The hand-operating vacuum pulling device 9 can also be used to move or remove a wooden plate, an automobile glass panel, or a tile.

Referring to FIGS. 7-11, the present invention provides a hand/pneumatics dual operation vacuum pulling device of which the hand-operating pump piston 3 described above can be removed out of the handgrip 5 and replaced by the pneumatic operation seat 6 of which the pneumatic sleeve 61 is receivable in the handgrip 5 in order to form a pneumatically-operating vacuum pulling device 8. The pneumatic operation seat 6 comprises a grasp stem 62 that is integrally combined with a pneumatic head 63. The pneumatic head 63 forms therein first, second, third passages 631, 632, 633 that are joined to each other in a T-shaped configuration. The first passage 631 is connected to a quick coupler 64 and a switch 65. The second passage 632 is connected to a one-way valve 66. The third passage 633 is connected to and in communication with the pneumatic sleeve 61 and is further set in communication with the suction cup 20 through a first fitting 18, the tube 13, a second fitting 19, and the through hole 21 of the suction cup 20. As such, the quick coupler 64 is connectable with a high pressure air supply tube 67 and the switch 65 can be opened to allow the pressurized air to flow through the first and second passages 631, 632 and discharge outward through the one-way valve 66. The flow of the pressurized air causes evacuation of the air contained in the suction cup 20 to induce vacuum. By closing the switch 65, the vacuum so induced drives the one-way valve 66 to a closed position, so that the vacuum inside the suction cup 20 can self-sustain. Under this condition, the high pressure air supply tube 67 can be removed and a metal sheet pulling operation can be carried out. The interference and inconvenience caused by entangling of tube may thus be eliminated during the pulling operation.

Referring to FIGS. 7-11, the interior space of the pneumatic head 63 that is used in drawing in air for inducing vacuum is in communication, through the tube 13, with the suction space of the suction cup 20, whereby when the high pressure air supply tube 67 continuously supplies through, the quick coupler 64 and the switch 65, pressurized air that is then conducted through the second passage 632 to be discharged outward through the one-way valve 66, the air contained in the suction cup 20 is drawn off by flowing through the tube 13 and the second passage 632 to gradually induce vacuum inside the suction cap. When the vacuum suction force reaches an optimum level or a desired level, the switch 65 is closed and the one-way valve 66 is caused by the vacuum to close, allowing the vacuum condition inside the suction cup 20 to self-sustain without any additional supply of pressurized air. Under this condition, the high pressure air supply tube 67 can be removed.

The one-way valve 66 comprises a rubber membrane 661 that is mounted to a guide block 662 that in a guide casing 663. The guide casing has an inside surface forming a plurality of guide ribs 6631 for guiding movement of the guide block 662 and preventing the guide block 662 from rotation. An air inlet opening 6632 is formed at one side of the guide casing 663 and is blocked and sealed by the rubber membrane 661 of the guide block 662 when it is desired to sustain the vacuum suction force. On the other hand, when a desired vacuum level is not reached, the guide bock 662 is moved away off the air inlet opening so that air can be drained through a holed plate 664 arranged at an opposite opening of the guide casing 663 for discharging the air to the atmosphere.

Figure 11:
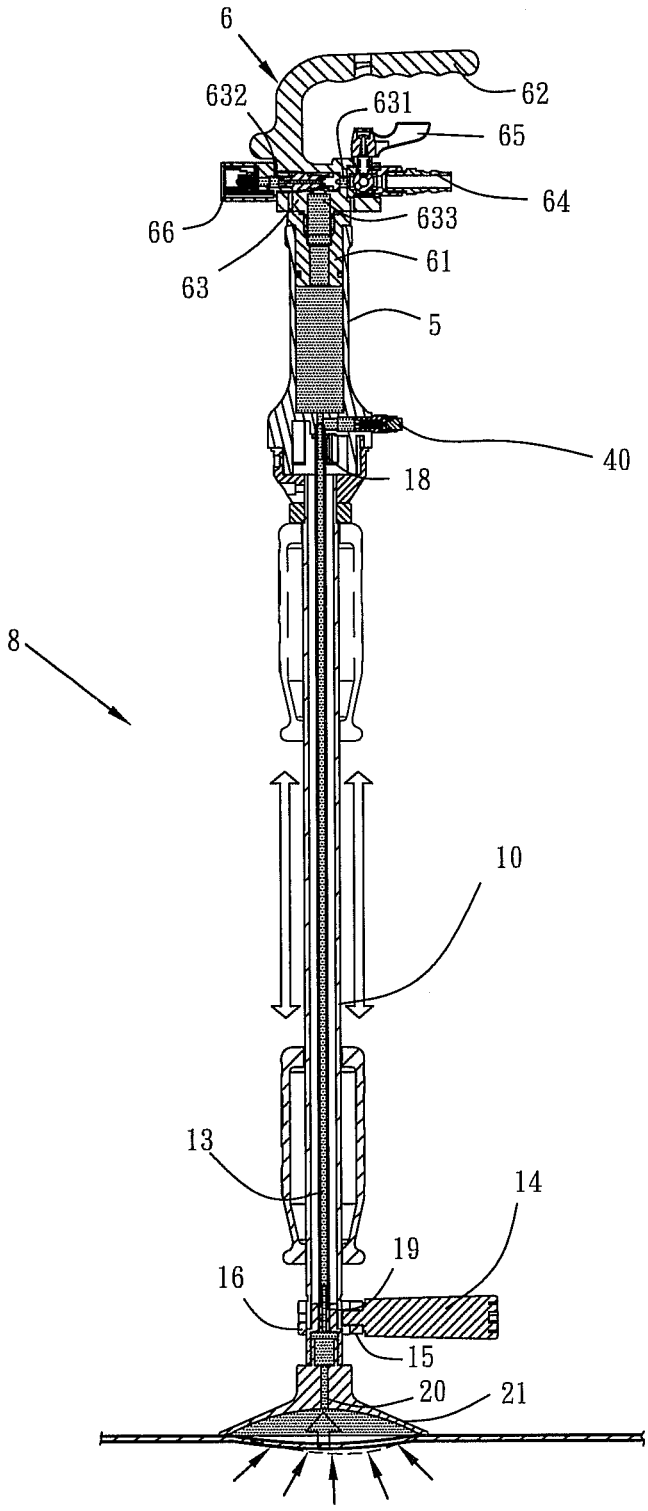
FIG. 11 is a cross-sectional view showing an operation of a backward ram of the dual operation vacuum pulling device of the present invention that is used with the pneumatic operation seat to form the pneumatically-operating vacuum pulling device.

With the suction cup 20 reaching a predetermined level of suction force, the backward ram 11 is instantaneously and forcibly moved toward and thus impacting the ram stop section 12 so as to generate a backward impact force as shown in FIG. 11, which pulls the elongate shank 10 and the suction cup 20 backward to induce a pulling action that pulls, through the suction cup 20, and levels a dent formed in a metal sheet. In this way, repairing of dent of metal sheet can be done without removing internal part of a car. The pneumatically-operating vacuum pulling device can also be used to move or remove a wooden plate, an automobile glass panel, or a tile.

After the metal sheet dent has been repaired, the switch 65 is opened, due to the high pressure air supply tube 67 being removed, direct communication is established between the internal vacuum condition and the atmosphere so that the vacuum condition will be released, or alternatively, the suction cup 20, which is generally flexible, can be manually and slightly deformed to form a gap through which air may flow into the suction cup 20 to release the vacuum condition.

Figure 12:
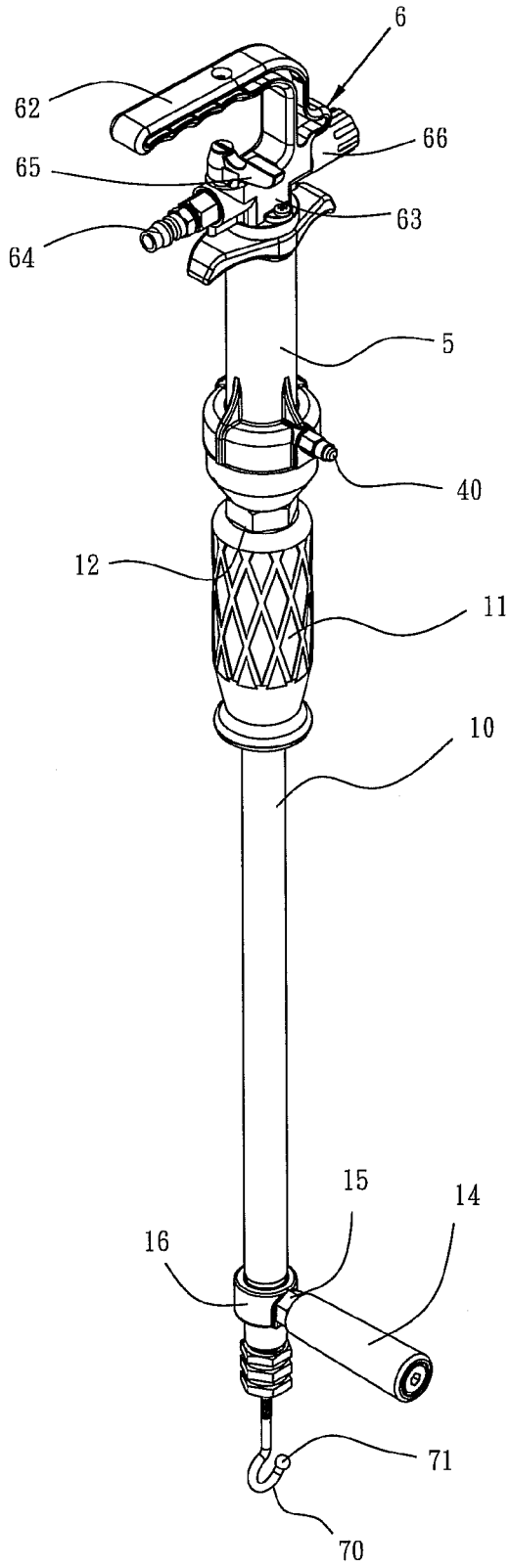
FIG. 12 is a perspective view showing the dual operation vacuum pulling device of the present invention that is used with the pneumatic operation seat to form the pneumatically-operating vacuum pulling device with a hook being used to replace a suction cup.
Figure 13:
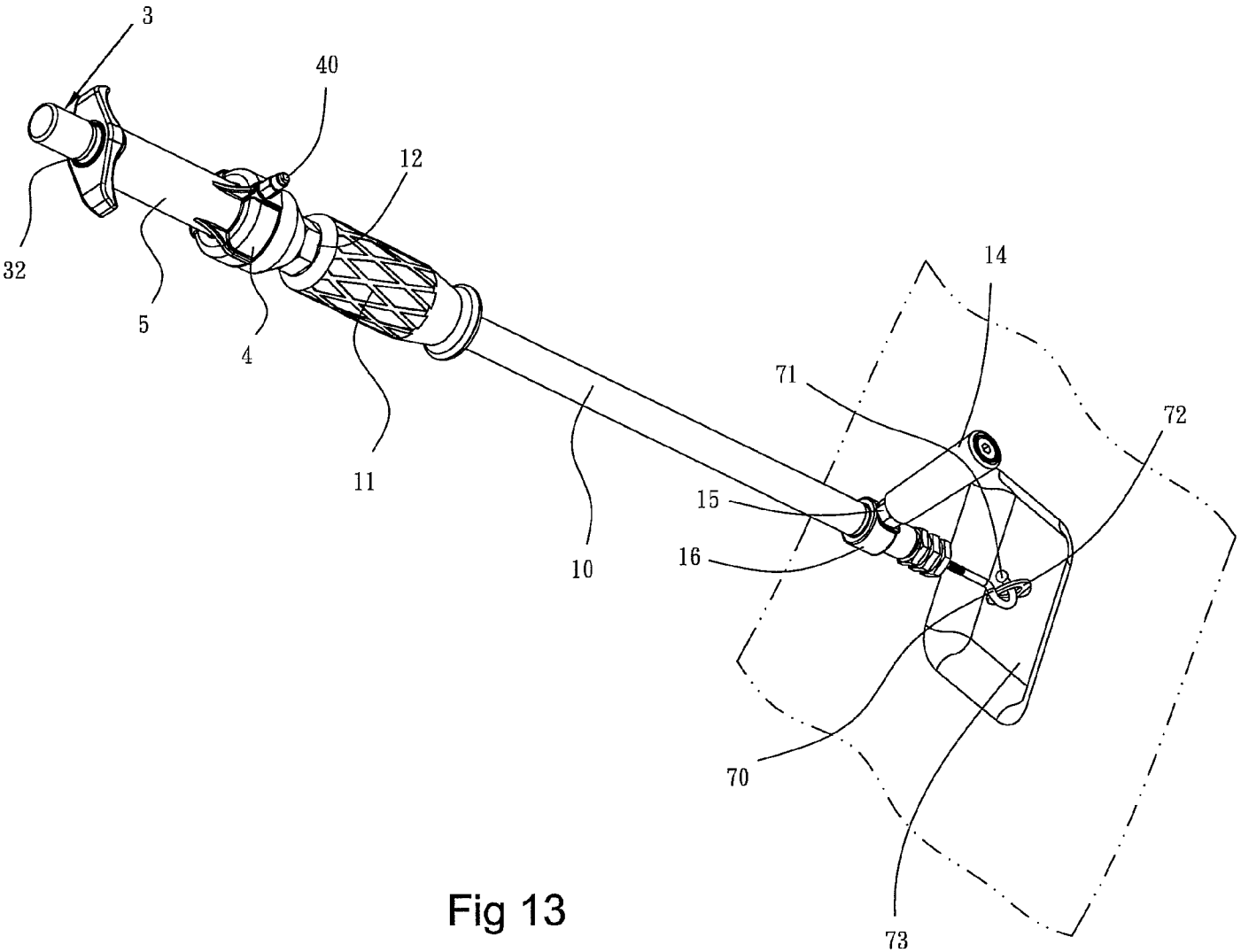
FIG. 13 is a perspective view showing the dual operation vacuum pulling device of the present invention that is used with the hand-operating pump piston to form the hand-operating vacuum pulling device with a hook being used to replace a suction cup.

Referring to FIGS. 12 and 13, the present invention provides a hand/pneumatics dual operation vacuum pulling device, of which the suction cup 20 can be replaced by a hook 70 that has front tip forming a spherical body 71 for the purposes of protection against inadvertently damaging tubes or hurting users. The hook 70 converts the pneumatically-operating vacuum pulling device 8 or the hand-operating vacuum pulling device 9 into a destruction tool, a dismantling tool, a hooking too, or a pulling tool for deformed metal sheet. In other words, the pulling device with the hook 70 mounted thereof may be used as a destruction tool for destructing doors or windows of a damaged house that is ruined in for example an earthquake in order to clear a way for escape, or be used as a hooking and dismantling tool for removing glass panel having adhesive residues thereon, for the adhesive residues make it hard for dismantling, so that with the hook 70 hooking the glass panel, the vibration caused by the backward ram 11 can be applied to removing the glass panel. Or, for a deformed metal sheet having a deformation area exceeding the size of the suction cup 20, a ring 72 may first be attached, through for example welding, to the deformed metal surface 73, and then the hook 70 is put to hook the ring 72 for subsequently pulling up the deformed portion of the metal sheet. Or, the device can be used through hooking and different advantages can be achieved.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A hand/pneumatics dual operation vacuum pulling device, comprising:

an elongate shank, which has a free end forming a first internal threading;

a suction cup, which forms a first external threading and has a top end forming a through hole;

a coupling member, which forms a second external threading mating the first internal threading of the elongate shank to connect the coupling member to the end of the elongate shank and a second internal threading for mating the first external threading of the suction cup to couple the suction cup to the coupling member;

a backward ram, which is slidably fit to the elongate shank;

a ring, which is fit to the elongate shank;

a transverse handle, which has a third external threading engaging and extending through a nut and the third internal threading of the ring to abut the elongate shank;

a handgrip, which is mounted to an upper end of the elongate shank and comprises a pressure relief seat;

a tube, which is received in the elongate shank and communicates with the handgrip via a first fitting and the through hole of the suction cup via a second fitting mounted inside the coupling member to set up fluid communication between the suction cup and the handgrip; and a ram stop section, which is arranged under the pressure relief seat to set a stop to sliding movement of the backward ram, wherein a hand-operating pump piston has an end selectively and removably coupled to and communicating with the handgrip to form a hand-operating vacuum pulling device; and a pneumatic operation seat is interchangeably and replaceably coupled to and communicating with the handgrip with a pneumatic sleeve so as to form a pneumatically-operating vacuum pulling device.

2. The hand/pneumatics dual operation vacuum pulling device as claimed in claim 1, wherein the pressure relief seat has an end to which a pressure relief valve is mounted, the pressure relief valve comprising a relief button, whereby the relief button when pressed down causes an elastic element to move away from a plug so as to allow air to flow from the relief button into the tube and the suction cup to release a vacuum condition inside the suction cup.

3. The hand/pneumatics dual operation vacuum pulling device as claimed in claim 1 further comprising a hook, which selectively replaces the suction cup of the hand-operating vacuum pulling device, the hook having a front end forming a spherical body, the hook being useful for destruction, hooking, pulling, pulling of large area or irregular deformation of a metal sheet.

4. The hand/pneumatics dual operation vacuum pulling device as claimed in claim 1, wherein the pneumatic operation seat comprises:

a grasp stem; and a pneumatic head, which is integrally combined with the grasp stem and forms therein a T-shaped configuration of air passages comprising a first passage, a second passage, and a third passage joined together, wherein the first passage is connected, via a switch, to a quick coupler that is adapted to connect a high pressure air supply tube, so that the switch selectively allow or shut off a pressurized air flow supplied from the high pressure air supply to the pneumatic head, a second passage, which is connected to a one-way valve that allows the pressurized air flow to discharge from the pneumatic head, a third passage, which is connected to and in communication with the pneumatic sleeve and is further in communication with the suction cup via the tube, whereby by opening the switch, the pressurized air is allow to flow through the first and second passages to discharge through the one-way valve and causes a flow or pressurized air that evacuates air contained in the suction cup via the tube and the third passage to form a vacuum and by closing the switch, the vacuum drives the one-way valve to a closed position to make the vacuum inside the suction cup self-sustaining.

5. The hand/pneumatics dual operation vacuum pulling device as claimed in claim 4, wherein the one-way valve comprises a rubber membrane mounted to a guide block that is movable in a guide casing, the guide casing having an inside surface forming guide ribs for guiding the movement of the guide block and preventing the guide block from rotation, an air inlet opening being formed at one side of the guide casing to be selectively blocked and sealed by the rubber membrane of the guide block that is moved by the vacuum for maintaining the vacuum, wherein when the guide bock is selectively moved away from the air inlet opening, air is allowed to drain through a holed plate arranged at an opposite opening of the guide casing for discharging to the atmosphere.

6. The hand/pneumatics dual operation vacuum pulling device as claimed in claim 1 further comprising a hook, which selectively replaces the suction cup of the pneumatically-operating vacuum pulling device, the hook having a front end forming a spherical body, the hook being useful for destruction, hooking, pulling, pulling of large area or irregular deformation of a metal sheet.

7. The hand/pneumatics dual operation vacuum pulling device as claimed in claim 1 further comprising an additional suction cup of a different size to selectively replace the suction cup.

* * * * *